US005434585A

United States Patent [19]

Harris

[11] Patent Number: 5,434,585

[45] Date of Patent: Jul. 18, 1995

[54] MICROWAVE ANTENNA HAVING A GROUND ISOLATED FEEDHORN

[75] Inventor: James M. Harris, Terrell, Tex.

[73] Assignee: Gardiner Communications, Inc., Garland, Tex.

[21] Appl. No.: 979,176

[22] Filed: Nov. 20, 1992

[51] Int. Cl.[6] ..... H01Q 13/02

[52] U.S. Cl. ..... 343/786; 343/772; 343/781 R

[58] Field of Search ..... 343/781 R, 786, 772; H01Q 13/02, 13/06, 13/00

[56] References Cited

U.S. PATENT DOCUMENTS

| | | | |
|---|---|---|---|
| 3,019,281 | 1/1962 | Hartwell | 174/35 |
| 3,140,342 | 7/1964 | Ehrreich et al. | 174/35 |
| 3,400,344 | 9/1968 | Booth | 333/98 |
| 3,553,707 | 5/1969 | Yang et al. | 343/786 |
| 3,796,449 | 3/1974 | McLaughlin | 285/405 |
| 3,815,139 | 4/1974 | Lewis et al. | 343/781 R |
| 4,504,836 | 3/1985 | Seavy | 343/786 X |
| 4,628,323 | 12/1986 | Cream | 343/882 |
| 4,755,828 | 7/1988 | Grim | 343/786 |
| 4,760,403 | 7/1988 | Grim | 343/786 |
| 4,878,037 | 10/1989 | Mathews et al. | 333/254 |
| 4,879,534 | 11/1989 | Spinner | 333/257 |
| 4,932,673 | 6/1990 | Domnikov et al. | 277/235 |
| 5,001,444 | 3/1991 | Salvan et al. | 333/135 |
| 5,103,237 | 4/1992 | Weber | 343/786 |
| 5,229,736 | 7/1993 | Adams et al. | 343/786 |

*Primary Examiner*—Donald Hajec
*Assistant Examiner*—Steven Wigmore
*Attorney, Agent, or Firm*—Harris, Tucker & Hardin

[57] ABSTRACT

A microwave antenna has a circular wave guide feedhorn mounted above a reflector. An electrically insulating sleeve fits around the outer diameter of circular wave guide. A scalar ring is secured to the insulating sleeve. The sleeve isolates the ground of the circular wave guide from the reflector and scalar ring so that electrostatic charge accumulating in the reflector does not damage electronic components electrically coupled to the wave guide.

19 Claims, 3 Drawing Sheets

MICROWAVE ANTENNA HAVING A GROUND ISOLATED FEEDHORN

FIELD OF THE INVENTION

The invention relates to feedhorns for microwave frequency antennas and more particularly to feedhorns that are isolated from electrostatic discharges that accumulate around reflector dishes of satellite antennas.

BACKGROUND OF THE INVENTION

In C-band microwave communications, electromagnetic energy is typically collected and focused using a parabolic reflector into an opening for a circular wave guide positioned near the focal point of the reflector. This circular wave guide is mounted through an opening in the center of a scalar ring. A scalar ring is an integrally formed circular metal plate with multiple concentric "ribs" coaxial with the opening of the plate. It is typically supported above the reflector using some sort of tripod mount. The circular wave guide is secured to the scalar ring with set screws through a sleeve integrally formed with the plate. The back end of the circular wave guide is coupled to a rectangular wave guide for mating with a low-noise block down-converter unit that transforms and down-converts the frequency of the microwave signal to an IF signal for transmission to a receiver unit.

The reflector tends to accumulate electric charge due to atmospheric ionization. Since there is a ground path through the wave guide and low-noise block down-converter to the receiver, the accumulation of sufficient charge may sometimes cause damage to circuitry in the low-noise down-converter when it is discharged or when it raises the potential of the feedhorn significantly above ground.

Prior art solutions to the problem have involved placing an electrically insulating gasket between the wave guide portion of the low noise converter unit and the wave guide. Insertion of an insulator in that position, however, substantially interferes with the propagation of the microwave down the wave guide and thus seriously compromises performance of the antenna system.

SUMMARY OF THE INVENTION

To overcome this problem, the invention utilizes a non-conductive sleeve placed between the feedhorn and the scalar ring. The insulating sleeve isolates the wave guide, and thus the block down-converter, from DC or transient charges associated with the reflector. In order to utilize this insulating sleeve, an additional rib must be placed in the scalar ring adjacent the sleeve. Otherwise, the insulator sleeve interferes with the scalar ring's ability to suppress side lobes.

In accordance with other aspects of the invention, the insulating sleeve also provides a new method of mounting the wave guide through the scalar ring. The sleeve supports the circular wave guide and is secured to the scalar ring by use of a strap compressing a portion of the sleeve firmly against the wave guide that has a series of notches for allowing bending of the sleeve. Installation and subsequent adjustment is thus simplified; tightening of set screws is unnecessary.

In accordance with still further aspects of the invention, a sleeve on the scalar ring for attaching the scalar ring to the wave guide is removed. The plate of the scalar ring does not have the structural strength formerly required for the sleeve in order for the scalar ring to withstand buffeting forces of wind. Consequently, with the sleeve removed and the plate thinner, the weight of the scalar ring is significantly reduced. Manufacturing and, most especially, transporting the scalar ring is less expensive.

These and other aspects of the invention and their advantages are illustrated in the accompanying drawings of the preferred embodiment of the invention, as described as follows.

DETAILED DESCRIPTION OF THE PREFERRED EMBODIMENT

Figure 1:
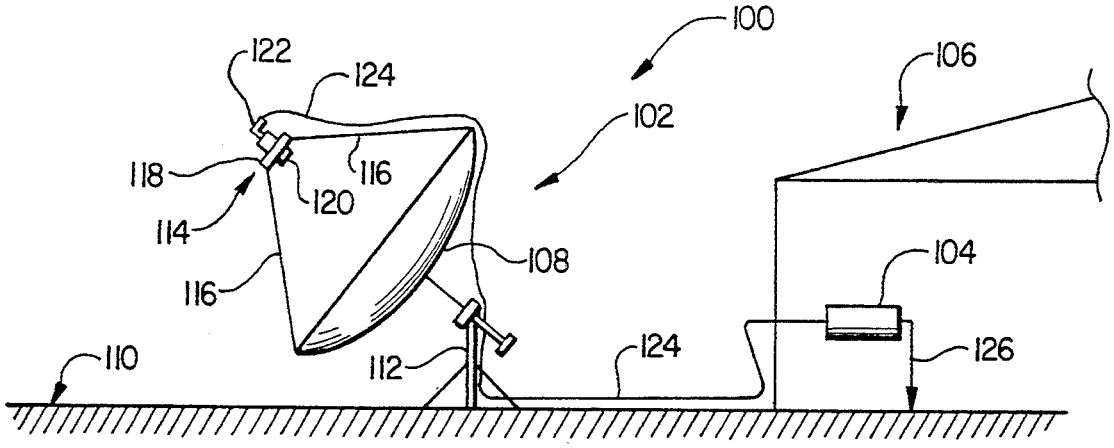
FIG. 1 is a schematic representation of an earth station serving as a satellite communications downlink, the earth station including a microwave antenna.

Referring now to FIG. 1, a satellite ground station 100 for receiving and/or transmitting includes a microwave antenna 102 and a receiver unit 104 within building 106. The microwave antenna includes a parabolic shaped reflector 108 supported above ground 110 with stand 112. A feedhorn assembly 114 is mounted above reflector 108, at or near its focal point, with support bars 116. The feedhorn assembly includes a scalar ring 118, to which the support bars 116 are attached. Through the center of the scalar ring is mounted wave guide 120. Wave guide 120 feeds a microwave frequency electromagnetic signal reflected from the surface and focused at an open end of the wave guide to a low noise, block down-converter unit 122. The down-converter unit couples the microwave signal in the wave guide to an amplifier and block down-converter circuit in the unit. The block down-converter converts the microwave signal to a UHF signal for transmission on coaxial cable 124 to receiver 104. The receiver is connected to ground with line 126.

Figure 3:
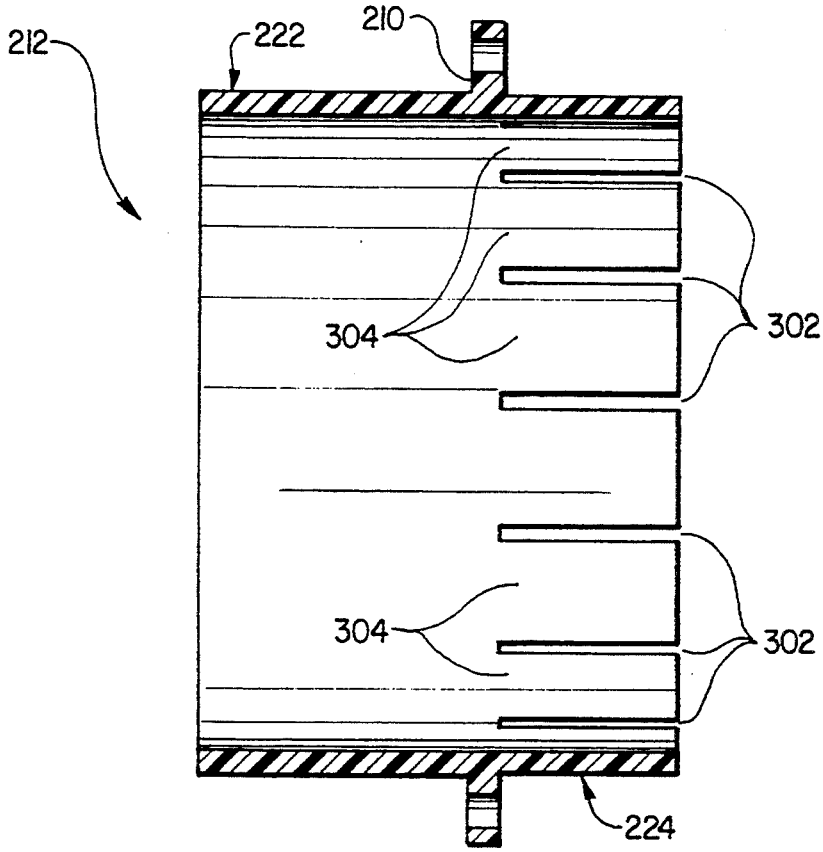
FIG. 3 is a cross-section of a sleeve shown in FIG. 2.
Figure 2:
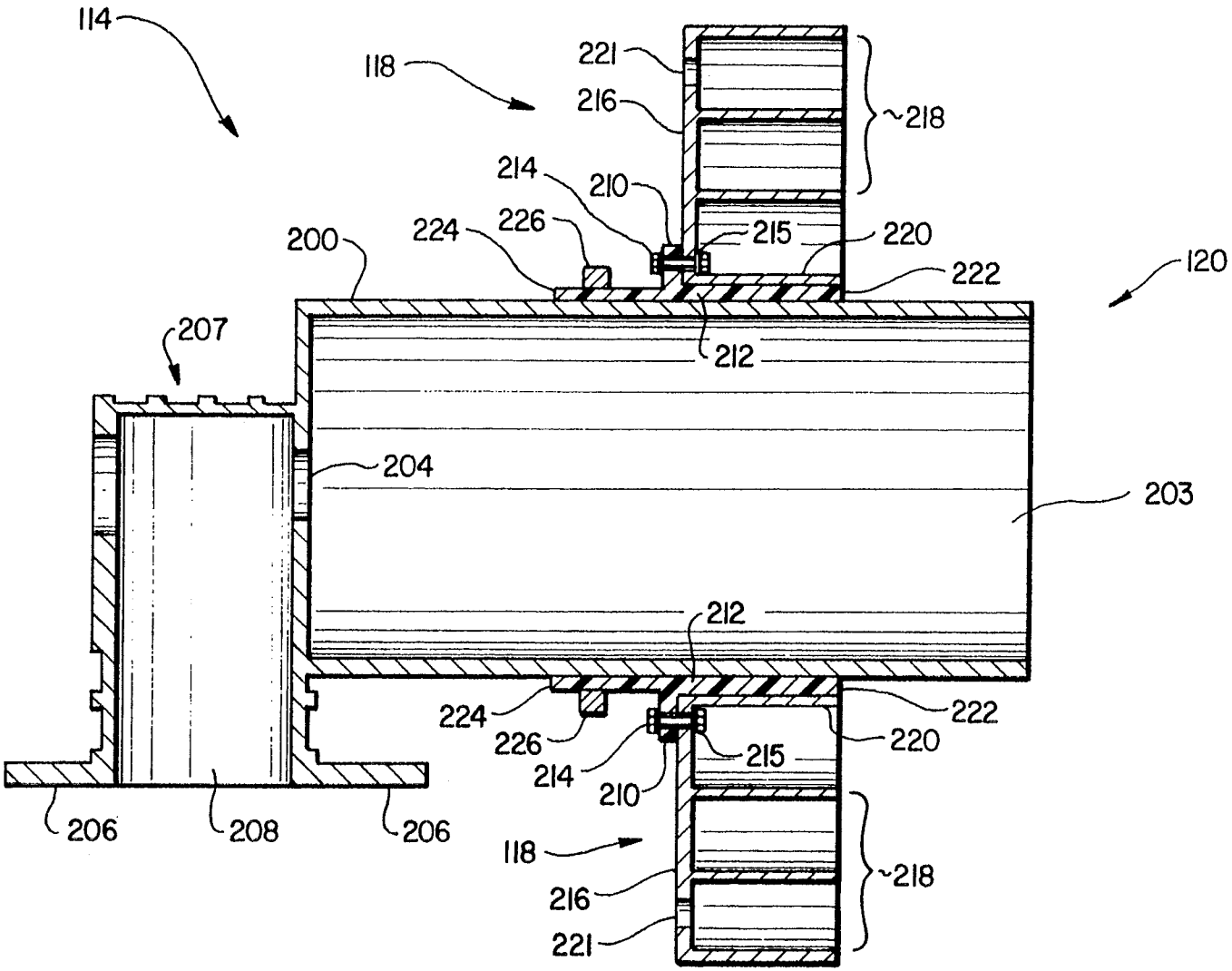
FIG. 2 is cross-section of a feedhorn shown in FIG. 1 with a sleeve and a scalar ring.
Figure 4:
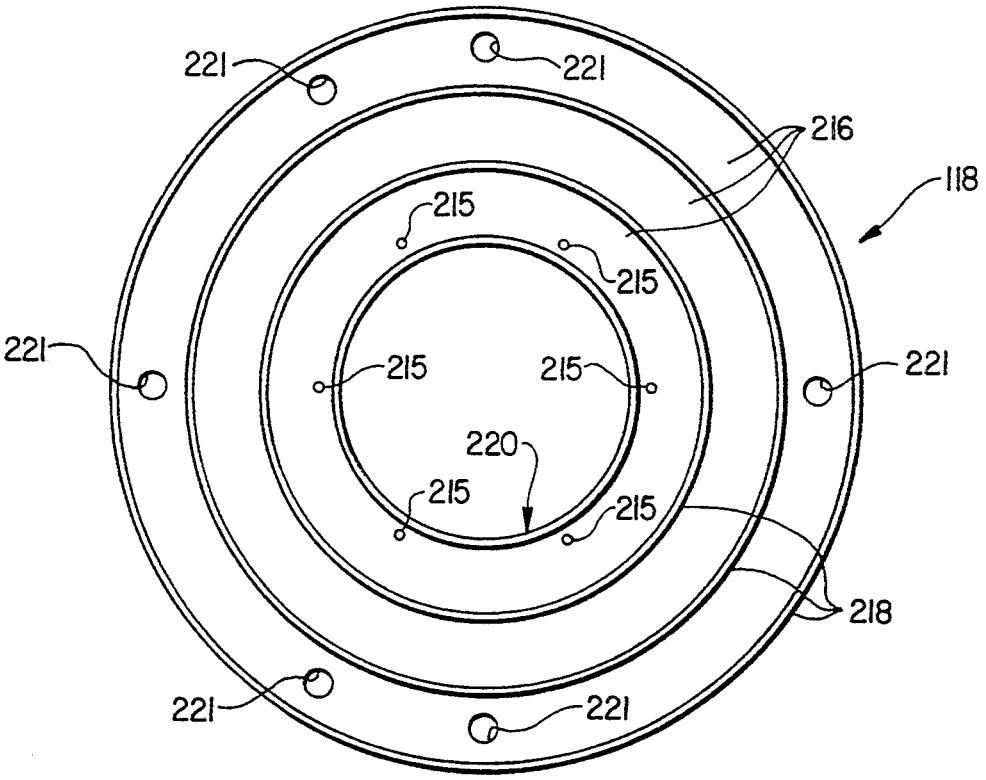
FIG. 4 is an elevational view of the front side of the scalar ring shown in FIGS. 1–3.

Referring now to FIGS. 2–4, a cross-section of feedhorn unit 114, wave guide 120 includes an integrally formed circular wave guide 200 and rectangular wave guide 202. Microwave signals received through opening 203 in the circular wave guide are coupled to the rectangular wave guide through port 204. The low noise block down-converter unit 122 (FIG. 1) is secured to flange 206 of the rectangular wave guide, across opening 208, to form a conductive connection between the block down-converter unit and the wave guide.

Scalar ring 118 is attached to flange 210 of insulating sleeve 212 with bolts 214 through holes 215 defined in plate portion 216 of the scalar ring and the flange 210. The scalar ring includes a plurality of ribs 218 extending perpendicularly from and integrally formed with plate 216 coaxially with and radially displaced from the outer circular wave guide 200. Unlike other scalar rings, the scalar ring also includes an inner rib 220 coaxial with the plurality of ribs 218 and immediately adjacent sleeve 212. Rib 220 is necessary for the scalar ring to suppress side lobes when placed adjacent insulating sleeve 212. The scalar ring is attached to pads on support bars 116

(FIG. 1 ) with bolts extending through holes 221 in plate 216.

Insulating sleeve 212 is preferably molded from electrically insulating plastic material for isolating the wave guide 120 and a block down-converter attached to it from electric potential associated with the scalar ring 118 and reflector 108 (FIG. 1). The insulating sleeve 212 has an internal diameter that allows it to slide down over the circular wave guide 200 but to have a relatively close fit with the outer diameter of the circular wave guide. The sleeve has a forward portion 222 that extends the length of inner rib 220 to ensure the wave guide 120 is completely insulated from the scalar ting. A rear portion 224 of the sleeve is inwardly deformable so that it is tightened against the circular portion 220 of the wave guide by application of a force from strap or band 226 placed around the sleeve's circumference. Strap or band 226 may be either metal or plastic and preferably can be loosened and tightened to facilitate assembly, adjustment and disassembly of the feedhorn assembly 114.

Referring now to FIG. 3 only, formed in rear portion 224 of insulating sleeve 212 are a plurality of equally spaced slots 302 or notches, each of which extends from the rear edge of the sleeve laterally along the length of the sleeve a predetermined distance. Between the slots are formed tabs 304. The tabs are deflected radially inwardly upon application of a tightening force by a strap or band around the outer diameter of the rear portion 224 of the sleeve.

Referring now to FIG. 4 only, a front, elevational view of the scalar ring by itself is illustrated. The scalar ring includes multiple concentric ribs 218 and inner rib 220 that extends perpendicularly from the front surface of plate 216. Bolts (not shown) extend through holes 222 in plate 216 for attaching the scalar ring to support bars 116 (FIG. 1). Bolts 214 (FIG. 2) extend through holes 215 for securing the scalar ring to flange 210 of insulating sleeve 212.

Figure 5:
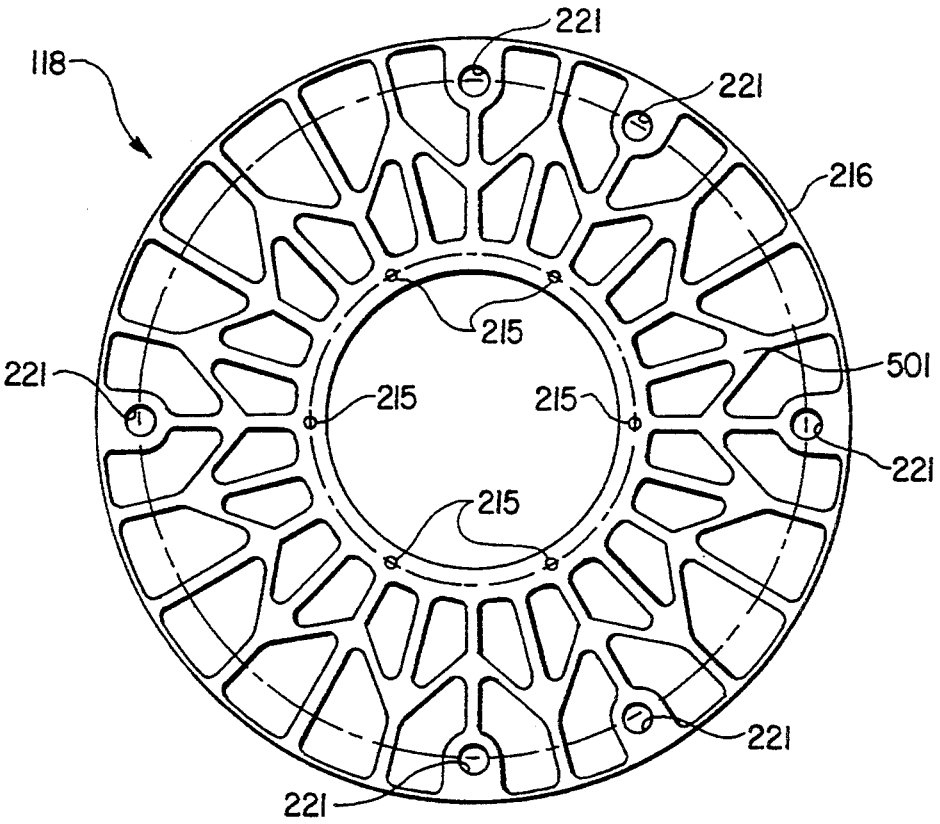
FIG. 5 is an elevational view of the back side of the scalar ring of FIG. 4.

Referring now to FIG. 5, the back of plate 216 of scalar ring 118 includes a honeycomb-like raised surface portions 501 that provide structural strength to plate 216 while reducing the weight of the plate.

Only the preferred embodiment has been described. Its description should is not to be construed as limiting the invention to the preferred embodiment. Numerous modifications and substitutions are possible to the preferred embodiment without departing from the scope and spirit of the invention as claimed.

What is claimed is:

1. A microwave antenna for isolating electromagnetic charge associated with the antenna from a receiver coupled to the antenna, the antenna comprising:

(a) feedhorn for gathering reflected microwave energy to a receiving unit, the feedhorn including a circular wave guide;

(b) a sleeve of electrically insulating material coaxial with and coupled to the circular wave guide;

(c) for reflecting and focusing microwave energy to the feedhorn;

(d) a scalar ring coaxial with the sleeve and circular wave guide and attached to the sleeve, wherein said scalar ring is maintained in a permanent fixed position relative to said feedhorn by said sleeve and wherein the scalar ring is electrically isolated from the feedhorn such that a charge on said scalar ring due to atmospheric ionization does not transfer to said feedhorn; and (e) a support extending from the reflector to the scalar ring for mounting the scalar ring, insulating sleeve and feedhorn above the reflector.

2. The microwave antenna of claim 1 wherein the sleeve includes inwardly bendable portion for allowing tightening of the sleeve against the circular wave guide, and wherein the antenna further includes a strap for tightening the bendable portion of the sleeve against the wave guide.

3. The microwave antenna of claim 2 wherein the inwardly bendable portion of the sleeve includes a plurality of notches extending laterally from one end of the sleeve.

4. The microwave antenna of claim 1 wherein the scalar ring includes a plurality of concentric fibs.

5. The microwave antenna of claim 4 wherein the scalar ring has one of the concentric ribs disposed adjacent to the sleeve.

6. The microwave antenna of claim 4 wherein the scalar ring includes a plate, the plurality of concentric ribs extending perpendicularly from the plate; wherein the sleeve includes a flange extending perpendicularly outwardly from the outer diameter of the circular wave guide, and wherein the flange is parallel with the plate for attaching the scalar ring and the sleeve.

7. The microwave antenna of claim 1 wherein the insulating sleeve is plastic.

8. The microwave antenna of claim 1 further comprising a down-converter unit coupled to the feedhorn for receiving microwave energy, the sleeve electrically insulating the down-converter circuit from the electrical energy flowing from the reflector.

9. A feedhorn for a microwave antenna comprising:

(a) a circular wave guide;

(b) a sleeve of electrically insulating material coaxial with and coupled to the circular wave guide; and (c) a scalar ring coaxial with the sleeve and circular wave guide and attached to the sleeve, such that the scalar ring is electrically isolated from the circular wave guide by the sleeve such that a charge on said scalar ring due to atmospheric ionization does not transfer to said feedhorn, and wherein said scalar ring is maintained in a permanent fixed position relative to the feedhorn by said sleeve.

10. The feedhorn of claim 9 wherein the scalar ring includes a plurality of concentric ribs.

11. The feedhorn of claim 10 wherein the scalar ring has one of the plurality of concentric ribs disposed adjacent the sleeve.

12. The feedhorn of claim 10 wherein the scalar ring includes a plate, the plurality of concentric ribs extending perpendicularly from the plate; and wherein the sleeve includes a flange extending perpendicularly outwardly from the outer diameter of the circular wave guide; the plate being secured to the flange.

13. The feedhorn of claim 9 wherein the insulating sleeve is plastic.

14. The feedhorn of claim 9 wherein the sleeve includes a plurality of notches extending inwardly from one end of the sleeve for allowing tightening of the sleeve against the circular wave guide.

15. The feedhorn of claim 14 wherein the feedhorn further includes a strap for tightening the notched portion of the sleeve against the wave guide.

16. A method of securing a scalar ring to a feedhorn having a circular wave guide comprising the steps of:

(a) placing a sleeve of insulating material over a portion of the outer diameter of the circular wave guide, the insulating material having a plurality of notches extending from one end of the sleeve a predetermined distance;

(b) tightening a strap around the notched portion of the sleeve to firmly press the sleeve against the circular wave guide; and (c) attaching the scalar ring to the insulating sleeve, such that the scalar ring is electrically isolated from the circular wave guide by the sleeve wherein said scalar ring is maintained in a permanent fixed position relative to said feedhorn by said sleeve, and wherein a charge on said scalar ring due to atmospheric ionization does not transfer to said feedhorn.

17. The method of claim 16 wherein the sleeve is plastic.

18. The method of claim 16 wherein the scalar ring has a rib adjacent the ins sleeve.

19. The method of claim 16 wherein the scalar ring includes a plurality of concentric ribs.

* * * * *

UNITED STATES PATENT AND TRADEMARK OFFICE

CERTIFICATE OF CORRECTION

PATENT NO. : 5,434,585

DATED : July 18, 1995

INVENTOR(S) : James M. Harris

It is certified that error appears in the above-indentified patent and that said Letters Patent is hereby corrected as shown below:

Col. 3
Claim 1, line 59, insert --a reflector-- before the word "for".
Col. 4
Claim 4, line 15, delete "fibs" and insert therefore --ribs--.
Col. 6
Claim 18, line 7, delete "ins" and insert therefore --insulating--.

Signed and Sealed this

Seventeenth Day of October, 1995

*Attest:*

Bruce Lehman

BRUCE LEHMAN

*Attesting Officer*

*Commissioner of Patents and Trademarks*